343-756 SR
5/5/81 XR 4,266,203

United States Patent [19] [11] 4,266,203
Saudreau et al. [45] May 5, 1981

[54] MICROWAVE POLARIZATION TRANSFORMER

[75] Inventors: Lucien Saudreau; Jean-Paul Biansan, both of Paris, France

[73] Assignee: Thomson-CSF, Paris, France

[21] Appl. No.: 880,282

[22] Filed: Feb. 22, 1978

[30] Foreign Application Priority Data

Feb. 25, 1977 [FR] France ..... 77 05585

[51] Int. Cl.[3] ..... H01P 1/17
[52] U.S. Cl. ..... 333/21 A; 343/756; 343/786
[58] Field of Search ..... 333/21 R, 21 A; 343/756, 754

[56] References Cited

U.S. PATENT DOCUMENTS 2,800,657 7/1957 Weil et al. ..... 343/756
3,708,796 1/1973 Gilbert ..... 343/756

FOREIGN PATENT DOCUMENTS 1572468 6/1969 France .

*Primary Examiner*—Paul L. Gensler
*Attorney, Agent, or Firm*—Karl F. Ross

[57] ABSTRACT

A microwave polarization transformer comprises a number of dielectric plates each having embedded therein one or two networks of parallel conductive wires in which switchable diodes are inserted. The plates are perpendicular to the direction of propagation of the waves on which they act and so oriented that the general direction of the wires of each network includes an angle of 45° with the direction of the electric field of the linearly polarized incident wave.

13 Claims, 5 Drawing Figures

MICROWAVE POLARIZATION TRANSFORMER

FIELD AND BACKGROUND OF THE INVENTION

Our present invention relates to a polarization transformer used in the microwave field. The interposition of such a transformer in the path of microwaves serves to convert the incident wave transmitted with a given polarization into an outgoing wave of different polarization. More particularly, such a transformer converts a wave having a linear polarization into a wave having a circular polarization, and vice versa, wherever such transformation is desired.

In the electromagnetic-detection field, for example, it is possible to change from the linear polarization of the incident wave to a circular polarization of the outgoing wave if it is desired to eliminate rain echoes, and in case of interference one may reduce the power of the interfering radiation by inverting this circular polarization. In the case where the objects pursued have for example an equivalent surface weak in circular polarization, their detection is facilitated by changing to a linear polarization. Different types of polarization transformers exist which are inserted in a free space in the path of a microwave beam or of semiguided waves, e.g. within a horn.

These types of polarization transformers, however, have to be adjusted mechanically when in operation.

A known polarization transformer of this mechanically adjustable type comprises a grating placed substantially in a phase plane and formed by metal strips which are perpendicular to the direction of propagation and include in a first position an angle with the electric-field vector of the radiated wave, e.g. of 45°, to transform the linear polarization of the incident wave into a circular polarization. If this polarization transformer is turned about an axis perpendicular to its plane so that the angle between the electric field of the radiated wave and the direction of the metal strips is made equal to 90°, the polarization of the incident wave, which is assumed to be linear, remains unaltered. Thus it is possible, by subjecting such a transformer to a rotation effected mechanically, to vary the polarization of the transmitted wave and convert in the described example the circular polarization into a rectilinear polarization.

Another conventional polarization transformer, also controlled mechanically, comprises a network of conductive wires mounted on thin dielectric supports. The wires are disposed in a plane perpendicular to the direction of propagation and include with the electric-field vector an angle of 45°, for example, in a first position corresponding to the creation of a circular polarization at the output of the polarizer. A rotation of this system in the aforementioned manner permits avoiding an alteration of the polarization of the incident wave, assumed to be rectilinear, by orienting the conductive wires perpendicular to the electric-field vector.

A further known polarization transformer comprises networks of conductive wires embedded within a set of dielectric plates whose thickness is such that the capacitive admittance of these networks is equal to half the inductive admittance of the networks of wires contained therein. The rotation of such a unit about an axis perpendicular to its plate faces enables the polarization of the outgoing waves to be changed in the way discussed above.

The physical displacement of at least a part of the transformer, required for the desired rotary adjustment, is often difficult and in some cases even impossible. Mechanical rotation of such a polarization transformer disposed in front of a horn constituting a primary source of a radar, for instance, may be prevented by the presence of dipoles placed around the horn.

OBJECT OF THE INVENTION

The object of our present invention, therefore, is to overcome this drawback by avoiding the need for mechanical movements in the use of polarization transformers and to design them in such a way that their operation can be controlled statically.

SUMMARY OF THE INVENTION

In accordance with our present invention, we provide a polarization transformer inserted in the path of microwaves for the purpose set forth, i.e. for delivering an outgoing wave having a polarization which is different from that of an incident wave from a juxtaposed radiation source, the transformer comprising one or more dielectric plates perpendicular to the direction of wave propagation each having one or two arrays or networks of parallel conductive wires embedded therein; the general direction of the conductive wires of each network includes an angle of the order of 45° with the direction of the electric field of the incident wave. At least one network of each plate has electronic switches, specifically diodes, inserted in the wires thereof and connected to a controlled supply of biasing voltage for selective forward and reverse biasing. The alternate blocking and unblocking of the diodes by associated switchover means modifies the network impedance for a codirectional component of the electric field.

BRIEF DESCRIPTION OF THE DRAWING

These and other features of our invention will become apparent from the ensuing description given with reference to the accompanying drawing in which.

SPECIFIC DESCRIPTION

Figure 1:
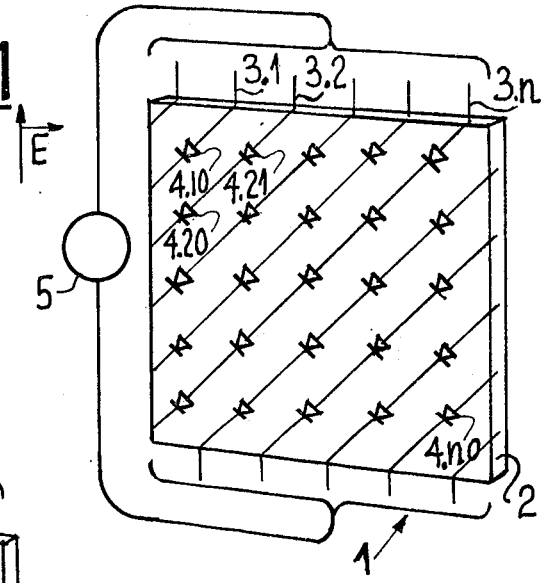
FIG. 1 shows a dielectric plate containing one set or network of conductive wires provided with switches.

FIG. 1 shows a dielectric plate 1 in whose body 2 there is embedded a set or network of conductive wires 3.1, 3.2, . . . 3.n interrupted by inserted electronic switches, namely diodes, designated 4.10, 4.20, 4.21, . . . 4.nO. All the wires are parallel to one another and spaced apart a predetermined distance ranging between approximately $\lambda/5$ and $\lambda/2$ where $\lambda$ is the wavelength in the dielectric. The diodes cascaded in any wire are generally spaced apart also a predetermined distance ranging between $\lambda/5$ and $\lambda$. These diodes are controlled by the selective application of a forward or reverse voltage from a biasing source 5, including switchover means not separately illustrated, across the wires.

For proper operation of plate 1 as a polarization transformer, the wires embedded therein are so oriented as to include an angle of about 45° with the direction of the electric-field vector $\vec{E}$ of an incident wave from a nonillustrated source which has a linear polarization. In this case, the components of the electric field E parallel to the wires of the dielectric plate induces in the network currents which vary in response to the phase shift produced by the switching of the diodes from one state to the other, while the perpendicular component retains its original phase angle. Thus, the impedance of the wire network changes with the state of the diodes. When the diodes are conductive the impedance of the network is inductive and produces a lead in the phase of the parallel component of the field vector, whereas when the diodes are blocked the impedance of the network is capacitive, or at least less inductive than in the preceding case, and produces a lag in the phase of the parallel component. Depending on the number of diodes that can be inserted in the conductive wires, and consequently on the dimensions of the plate, several phase-shift values can be obtained. If a certain state of the diodes causes a phase shift for the parallel component which is of the order of 90° relative to the perpendicular component, the wave issuing from the polarization transformer will have circular polarization provided that the incoming wave has linear polarization. If the differential phase shift obtained for one plate is insufficient, a plurality of similar plates may be stacked together until the desired phase shift is obtained. The number of plates is optional.

However, as the phase shift of the component parallel to the wires is not zero for the alternate state of the diodes, the initial polarization of the wave is not preserved in the latter state.

Figure 2:
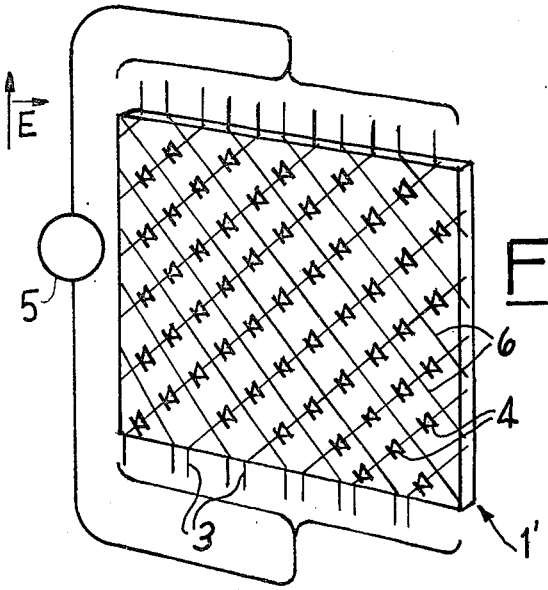
FIG. 2 shows a dielectric plate containing two mutually orthogonal networks of conductive wires, one of these networks including electronic switches.

In order to overcome this drawback, a dielectric plate 1' of the type shown in FIG. 2 may be employed. This plate 1' contains, embedded in its body, two sets or networks of parallel conductive wires 3, 6 whose orientation in one network is perpendicular to that in the other network. The wires 3' of the second network serve to produce a differential phase shift of such magnitude as to enable a return to the original linear polarization.

The wires 3 of the first network include diodes 4 like the network of the plate 1 shown in FIG. 1.

The first network is again connected to a controlled supply 5 of biasing voltage which permits a switching of its diodes 4.

Thus, this network acts in exactly the way described with reference to FIG. 1.

The array of wires 6, which acts on the component perpendicular to the wires 3, is arranged to have an inductive impedance equal to that of the first network in the state of the diodes which preserves the original linear polarization. This arrangement keeps unchanged the amplitudes of the components and their relative phase difference, the polarization of the outgoing wave being then again that of the incoming wave.

Figure 3:
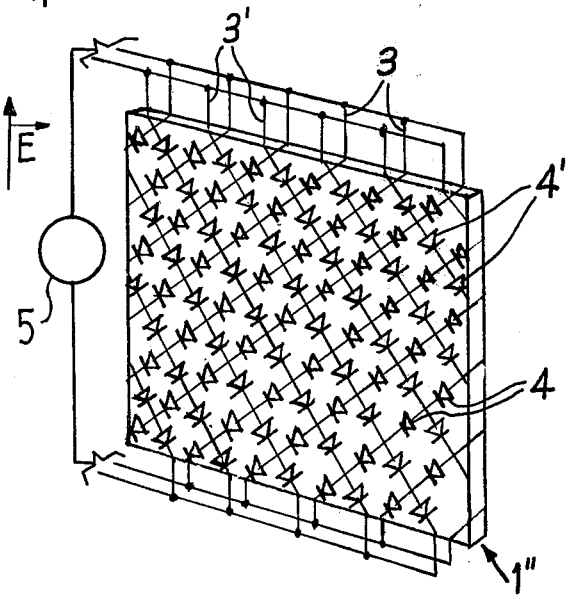
FIG. 3 shows a dielectric plate containing two wire networks each provided with electronic switches.

FIG. 3 shows a dielectric 1'' of the same type as that of FIG. 2 in which two networks of conductive wires 3, 3', each comprising respective diodes 4, 4' in series in the wires, are disposed perpendicular to each other. Each of the networks has its wires across the switchable supply 5 which applies a forward or reverse voltage to the diodes, depending on the state in which they are desired to be placed.

Under these conditions, with an electric field $\vec{E}$ directed vertically, it is possible to act simultaneously on the amplitudes and phase shifts of the two components of this field that are respectively parallel to the directions of the conductive wires of each network. This action permits transforming the linear polarization of the incoming wave into a left or right circular polarization of the outgoing wave, as the case may be.

Figure 4:
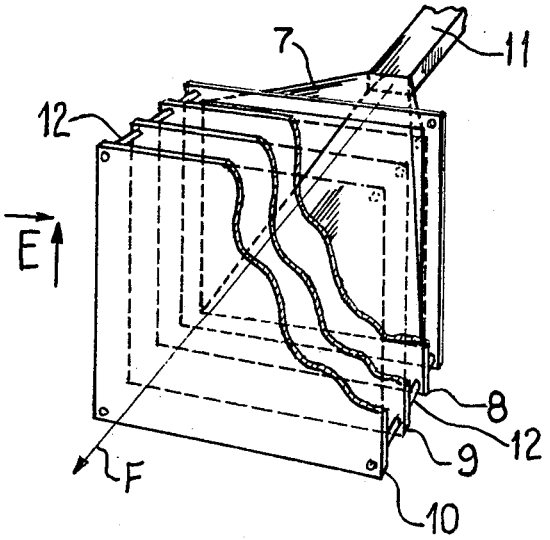
FIG. 4 shows diagrammatically a multiplate polarization transformer according to the invention juxtaposed with a radiation source.

FIG. 4 shows a multiplate polarization transformer embodying our present invention. This transformer adjoins the mouth of a horn 7 producing a wave whose polarization is linear and represented by the vector $\vec{E}$ perpendicular to the direction of wave propagation F, i.e. to the horn axis. The polarization transformer comprises here three dielectric plates 8, 9, 10 of the type described with reference to FIG. 3, each having two mutually orthogonal arrays of parallel conductive wires and series diodes embedded in its dielectric body. The wires of each array include an angle of 45° with the direction of the electric-field vector $\vec{E}$ of the incident wave. The horn 7 forms an extension of a rectangular waveguide 11 and is joined to plates 8–10 by rods 12.

It is clear from the explanations given in the course of the description of FIGS. 1 to 3 that, as a general rule, the polarization of the instant wave depends on the conductive or nonconductive state of the diodes. Four cases may be considered.

In a first case, it may be assumed that the diodes 4, 4' (FIG. 3) of the two networks 3, 3' are originally conductive. The polarization of the incident wave being assumed to be linear, the outgoing wave also has a linear polarization since no differential phase shift has been produced.

In a second case, the diodes of the first network 3 are conductive and those of the second network 3' are nonconductive; the incident linear polarization is transformed into a right circular polarization, for example.

In a third case, the diodes of the first network 3 are nonconductive and those of the second network 3' are conductive; the incident linear polarization is transformed into a left circular polarization.

In a fourth case, the diodes of the two networks are nonconductive. The original polarization of the incident wave is maintained.

However, from the point of view of operation, care must be taken to ensure that there are no reflected waves which might affect it. Reflected waves are suppressed by suitably selecting both the thickness of the dielectric plates and the spacing thereof in the assembly of the polarization transformer.

Thus, the thickness of the plates is such that the plates are adapted for a component of the field in a given state of the diodes. In most cases, this thickness is between $\lambda/10$ and $\lambda/200$.

The distance between the plates is then so chosen that the reflected waves are suppressed for the other state of the diodes. In practice, this distance is between $\lambda 5$ and $\lambda/2$.

The first plate 8 may be at a distance of $\lambda/20$ to $\lambda/10$ from the mouth of the horn.

Figure 5:
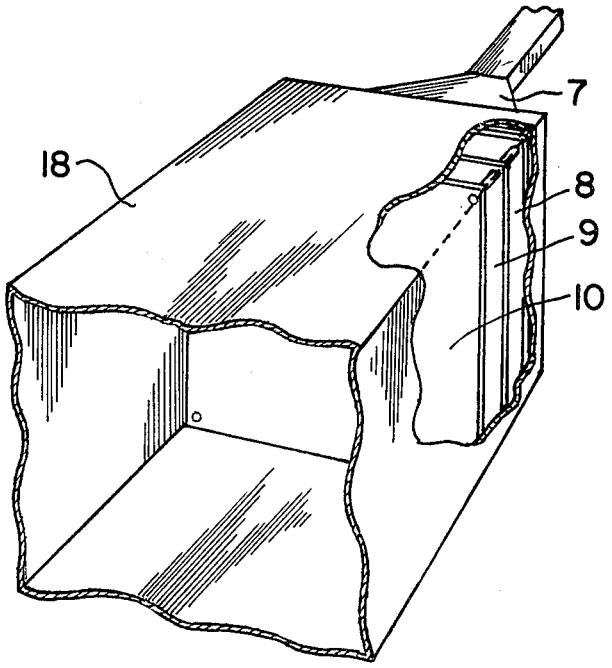
FIG. 5 shows a modification of the polarization transformer illustrated in FIG. 4.

FIG. 5 shows a polarization transformer similar to that of FIG. 4 whose plate 8–10 are in front of the horn 7 by a shroud 18 forming an extension of the walls of the horn parallel to the direction of wave propagation.

It will be understood that a polarization transformer according to the invention may be introduced into the path of waves coming from a reflector, constituting a secondary radiation source to which it is secured by any suitable means.

We claim:

1. In combination, a source of linearly polarized microwave radiation and a polarization transformer interposed in the path of said radiation, said transformer comprising:

at least one dielectric plate perpendicular to said path;

an array of parallel conductive wires embedded in said plate and oriented at an angle of substantially 45° to the direction of polarization of said radiation;

a multiplicity of electronic switches inserted in said wires within said plate;

a set of parallel conductive wires perpendicular to wires of said array embedded in said plate, the inductive impedances of said set and of said array being substantially identical in one state of said switches; and control means for selectively changing between a conductive state and a nonconductive state of all said switches, with transformation of said radiation to circular polarization in said conductive state.

2. The combination defined in claim 1, further comprising another multiplicity of electronic switches inserted in the wires of said set and operable by said control means independently of the switches inserted in the wires of said array.

3. The combination defined in claim 1 or 2 wherein said plate has a thickness ranging between substantially one tenth and two-hundredth of the wavelength of said radiation in the dielectric of said plate.

4. The combination defined in claim 1 or 2 wherein said plate is one of a plurality of substantially identical parallel plates spaced apart along said path.

5. The combination defined in claim 4 wherein said plates are separated by a distance ranging between substantially one fifth and one half of the wavelength of said radiation in the dielectric thereof.

6. The combination defined in claim 4 wherein said source comprises a rectangular waveguide terminating in a horn, said plate being juxtaposed with the mouth of said horn.

7. The combination defined in claim 6 wherein the plate closest to said horn is spaced from said mouth by a distance ranging between substantially one tenth and one twentieth of the wavelength of said radiation in the dielectric of said plate.

8. The combination defined in claim 6, further comprising a rectangular shroud extending forward from said horn, said plates being mounted in said shroud.

9. In combination, a source of linearly polarized microwave radiation and a polarization transformer interposed in the path of said radiation, said transformer comprising at least one dielectric plate perpendicular to said path, an array of parallel conductive wires embedded in said plate and oriented at an angle of substantially 45° to the direction of polarization of said radiation, the wires of said array being spaced apart by a distance ranging between substantially one fifth and one half of the wavelength of said radiation in the dielectric of said plate, a multiplicity of electronic switches inserted in said wires within said plate, and control means for selectively changing between a conductive state and a nonconductive state of all said switches, with transformation of said radiation to circular polarization in said conductive state.

10. In combination, a source of linearly polarized microwave radiation and a polarization transformer interposed in the path of said radiation, said transformer comprising at least one dielectric plate perpendicular to said path, said plate having a thickness ranging between substantially one tenth and one two-hundredth of the wavelength of said radiation in the dielectric of said plate, an array of parallel conductive wires embedded in said plate and oriented at an angle of substantially 45° to the direction of polarization of said radiation, a multiplicity of electronic switches inserted in said wires within said plate, and control means for selectively changing between a conductive state and a nonconductive state of all said switches, with transformation of said radiation to circular polarization in said conductive state.

11. The combination defined in claim 1, 2 or 10 wherein the wires of said array are spaced apart by a distance ranging between substantially one fifth and one half of the wavelength of said radiation in the dielectric of said plate.

12. The combination defined in claim 1, 2, 9 or 10 wherein said electronic switches are diodes.

13. The combination defined in claim 12 wherein certain of said wires are provided with a plurality of said diodes in cascade, the spacing of the cascaded diodes ranging between substantially 20% and 100% of the wavelength of said radiation in the dielectric of said plate.

* * * * *